US011022349B2

(12) United States Patent
Perrotin

(10) Patent No.: US 11,022,349 B2
(45) Date of Patent: Jun. 1, 2021

(54) HYDRONIC SYSTEM FOR COMBINING FREE COOLING AND MECHANICAL COOLING

(71) Applicants: Carrier Corporation, Farmington, CT (US); Marian Perrotin, Lyons (FR)

(72) Inventor: Marian Perrotin, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/745,065

(22) PCT Filed: Jul. 22, 2015

(86) PCT No.: PCT/IB2015/001370
§ 371 (c)(1),
(2) Date: Jan. 15, 2018

(87) PCT Pub. No.: WO2017/013461
PCT Pub. Date: Jan. 26, 2017

(65) Prior Publication Data

US 2018/0209701 A1 Jul. 26, 2018

(51) Int. Cl.
*F25B 25/00* (2006.01)
*F25B 41/04* (2006.01)
(Continued)

(52) U.S. Cl.
CPC ..... *F25B 25/005* (2013.01); *F25B 41/00* (2013.01); *F25B 41/20* (2021.01); *F25B 2339/047* (2013.01)

(58) Field of Classification Search
CPC ..... F25B 25/00; F25B 2339/047; F25B 2600/2507; F25B 2600/13; F25D 16/00;
(Continued)

(56) References Cited

U.S. PATENT DOCUMENTS 7,036,330 B2 5/2006 Grabon et al.
7,581,409 B2 9/2009 Bailey et al.
(Continued)

FOREIGN PATENT DOCUMENTS

CN 2304874 Y 1/1999
CN 101126528 A 2/2008
(Continued)

OTHER PUBLICATIONS

Dry Coolers, Inc., [online]; [retrieved on Jan. 15, 2018]; retrieved from the Internet http://drycoolers.com/products/free-coolers Dry Coolers, "Free Coolers," Drycoolers.com, 2018, pp. 1-2.
(Continued)

*Primary Examiner* — Jianying C Atkisson
*Assistant Examiner* — Meraj A Shaikh
(74) *Attorney, Agent, or Firm* — Cantor Colburn LLP

(57) ABSTRACT

A refrigeration system is provided including a refrigeration circuit and a free cooling system. The free cooling system includes a fluid cooling circuit and a free cooling circuit. The fluid cooling circuit is thermally and hydraulically coupled to the refrigeration circuit such that that a cooling fluid of the fluid cooling circuit is configured to transfer heat to the refrigerant. The free cooling circuit is thermally and hydraulically coupled to the refrigeration circuit such that a free cooling fluid of the free cooling circuit is configured to absorb heat from the refrigerant. The free cooling circuit and the fluid cooling circuit are thermally and hydraulically coupled through a free cooling heat exchanger. At least one valve is configured to control a flow within the free cooling circuit. The refrigeration system is operable in a free cooling mode, a mechanical cooling mode, and a combined free cooling and mechanical cooling mode.

12 Claims, 2 Drawing Sheets

(51) Int. Cl.
*F25B 41/00* (2021.01)
*F25B 41/20* (2021.01)

(58) Field of Classification Search
CPC ..... H05K 7/20281; H05K 7/20745; H05K 7/20763
USPC ..... 165/281, 287
See application file for complete search history.

(56) References Cited

U.S. PATENT DOCUMENTS

| | | | | |
|---|---|---|---|---|
| 2010/0023166 | A1 | 1/2010 | Chessel et al. | |
| 2010/0242532 | A1 | 9/2010 | Kopko et al. | |
| 2012/0103591 | A1* | 5/2012 | Tozer | F25D 16/00 165/281 |
| 2012/0125023 | A1 | 5/2012 | Kopko et al. | |
| 2013/0199222 | A1 | 8/2013 | Moses | |
| 2014/0260391 | A1* | 9/2014 | Kopko | F25B 25/005 62/238.6 |
| 2015/0068228 | A1* | 3/2015 | Sedlak | F25B 25/005 62/79 |
| 2015/0176865 | A1* | 6/2015 | McDonnell | F25B 29/003 62/506 |

FOREIGN PATENT DOCUMENTS

| | | | |
|---|---|---|---|
| DE | 19509716 | A1 | 9/1996 |
| DE | 102010049134 | A1 | 8/2011 |
| EP | 1134523 | A1 | 9/2001 |
| EP | 1855070 | A2 | 11/2007 |
| EP | 2148155 | A1 | 1/2010 |
| EP | 2233863 | A2 | 9/2010 |
| RU | 2239993 | C1 | 11/2004 |
| SU | 1506243 | A1 | 9/1989 |
| WO | 2010141392 | A1 | 12/2010 |
| WO | 2013171271 | A1 | 11/2013 |

OTHER PUBLICATIONS

Emerson Network Power, "Liebert AFC from 500 to 1450 kW: The Adiabatic Freecooling Solution with Top-Tier Availability," Rev. 3-11/2014, 2014, pp. 1-16. http://www.dataromskjoling.no/uploads/documents/Liebert_AFC_500-1450_kW.pdf.

Motivair Corp.com, [online]; [retrieved on Jan. 15, 2018]; retrieved from the Internet http://www.motivaircorp.com/files/uploads/2015/02/Motivair_MPC-2016_4WebLR.pdf Motivair Cooling Solutions, "MPC Air-Cooled Chillers, MPC-FC Free-Cooling Chillers," Motivair Corp, 2016, pp. 1-8.

PCT ISR Written Opinion; International Application No. PCT/IB2015/001370; International Filing Date: Jul. 22, 2015, dated Apr. 22, 2016, pp. 1-5.

PCT Notification of Transmittal of the International Search Report; International Application No. PCT/IB2015/001370; International Filing Date: Jul. 22, 2015, dated Apr. 22, 2016, pp. 1-5.

Thermo.co, [online]; [retrieved on Jan. 15, 2018], retrieved from the Internet http://thermo.co.nz/download/indigo_thermo_brochure_current.pdf Star Refrigeration, "Indigo-termosyphon Chiller: Ultra Efficient Free Cooling for Data Centers," 2018, pp. 1-7.

Federal Service for Intellectual Property (Rospatent), Russian Federation, Office Action of the Substantive Examination, Application No. 2018104550/06(006805), dated Feb. 25, 2019, English translation provided (13 pp.).

Chinese Office Action; International Application No. 201580081906.3; International Filing Date: Jan. 22, 2018; dated Oct. 31, 2019; 9 pages.

Indian Office Action; International Application No. 201817002028; International Filing Date: Jan. 18, 2018; dated May 27, 2020; 5 pages.

Decision of Rejection; International Application No. 201580081906.3; International Filing Date: Jan. 22, 2018; dated Nov. 20, 2020; 9 pages.

* cited by examiner

HYDRONIC SYSTEM FOR COMBINING FREE COOLING AND MECHANICAL COOLING

CROSS REFERENCE TO RELATED APPLICATIONS

This application is a US National Stage application of PCT/IB2015/001370, filed Jul. 22, 2015, which is incorporated herein by reference in its entirety.

BACKGROUND

The present disclosure relates to refrigeration systems, and more particularly, the present disclosure relates to methods and systems for operating a refrigeration system in a free-cooling mode and a mechanical cooling mode.

Conventional refrigeration systems operate by circulating a fluid, such as refrigerant, through a closed thermodynamic loop. During the cycle, heat is absorbed from a medium on the evaporator side and rejected to a medium on the condenser side. During these heat transfer processes at pressure conditions defined by the temperature levels of the source and sink temperatures, the refrigerant undergoes phase changes occurring during heat transfer processes. This cyclic transformation occurs due to mechanical compression or work provided to the refrigerant by a compressor and a pressure expansion device and is referred to as a "mechanical cooling mode". Typically in the evaporator, the refrigerant enters a heat exchanger and cools a medium such as water, air, or glycol, which in turn may be used to cool a conditioned space. Applications of refrigeration systems include cooling of commercial and residential buildings, data centers, industrial equipment, agriculture and food.

However, when the temperature of the ambient outside air is low, the outside air may be used to cool the medium without engaging the compressor. In such instances, the refrigeration system includes several additional components connected to the refrigeration system through one or more hydraulic loops. When cool ambient air is used by the refrigeration system in place of the compressor, the system is referred to as operating in a "free-cooling mode." In the free-cooling mode, one or more ventilated heat exchangers and pumps are activated and the cooling medium circulating throughout the refrigeration system is cooled indirectly by outside ambient air without the need for a compressor. Because running the refrigeration system in a free-cooling mode requires less work input, running the system in free-cooling mode is more efficient than run g the system in mechanical cooling mode.

Traditionally, refrigeration systems have been run in a mechanical cooling mode even when the ambient outside air temperature is low. In contrast, running the refrigeration system under such conditions in a free-cooling mode is more efficient. Accordingly, there is a need for a system configured to operate in one of both a mechanical cooling mode and a free-cooling mode.

SUMMARY

According to an embodiment of the present disclosure, a refrigeration system is provided including a refrigeration circuit and a free cooling system. The free cooling system includes a fluid cooling circuit and a free cooling circuit. The fluid cooling circuit is thermally and hydraulically coupled to the refrigeration circuit such that that a cooling fluid of the fluid cooling circuit is configured to transfer heat to the refrigerant. The free cooling circuit is thermally and hydraulically coupled to the refrigeration circuit such that a free cooling fluid of the free cooling circuit is configured to absorb heat from the refrigerant. The free cooling circuit and the fluid cooling circuit are thermally and hydraulically coupled through a free cooling heat exchanger. At least one valve is configured to control a flow within the free cooling circuit. The refrigeration system is operable in a free cooling mode, a mechanical cooling mode, and a combined free cooling and mechanical cooling mode.

In addition to one or more of the features described above, or as an alternative, in further embodiments the free cooling circuit includes a heat exchanger configured to reject heat from the free cooling fluid to ambient air.

In addition to one or more of the features described above, or as an alternative, in further embodiments the free cooling circuit is thermally and hydraulically coupled to the condenser and the fluid cooling circuit is thermally and hydraulically coupled to the evaporator.

In addition to one or more of the features described above, or as an alternative, in further embodiments the free cooling heat exchanger is located upstream of the condenser with respect to a flow of the free cooling fluid through the free cooling circuit.

In addition to one or more of the features described above, or as an alternative, in further embodiments the free cooling heat exchanger and the condenser are arranged in parallel with respect to a flow of the free cooling fluid through the free cooling circuit.

In addition to one or more of the features described above, or as an alternative, in further embodiments the at least one valve is positioned upstream from the free cooling heat exchanger.

In addition to one or more of the features described above, or as an alternative, in further embodiments the at least one valve includes a valve positioned upstream from the condenser.

In addition to one or more of the features described above, or as an alternative, in further embodiments the at least one valve is positioned downstream from the free cooling heat exchanger.

In addition to one or more of the features described above, or as an alternative, in further embodiments the free cooling heat exchanger is located upstream of the evaporator with respect to a flow of the cooling fluid through the fluid cooling circuit.

In addition to one or more of the features described above, or as an alternative, in further embodiments the free cooling circuit includes a pump configured to move the free cooling fluid through the free cooling circuit.

In addition to one or more of the features described above, or as an alternative, in further embodiments the fluid cooling circuit includes a pump configured to move the cooling fluid through the fluid cooling circuit.

In addition to one or more of the features described above, or as an alternative, in further embodiments the at least one valve is selected from a three-way valve and a two-way valve.

In addition to one or more of the features described above, or as an alternative, in further embodiments a controller is configured to control operation of the refrigeration system in one of the free cooling mode, mechanical cooling mode, and a combined free cooling and mechanical cooling mode based on a cooling load and an outside temperature.

In addition to one or more of the features described above, or as an alternative, in further embodiments the controller is operably coupled to the compressor, a pump, and the at least one valve. The controller is configured to operate one or more of the compressor, the pump, and at least one valve when switching between the free cooling mode, mechanical cooling mode, and a combine free cooling and mechanical cooling mode.

BRIEF DESCRIPTION OF THE DRAWINGS

The subject matter, which is regarded as the present disclosure, is particularly pointed out and distinctly claimed in the claims at the conclusion of the specification. The foregoing and other features, and advantages of the present disclosure are apparent from the following detailed description taken in conjunction with the accompanying drawings in which:

The detailed description explains embodiments of the present disclosure, together with advantages and features, by way of example with reference to the drawings.

DETAILED DESCRIPTION

Figure 1:
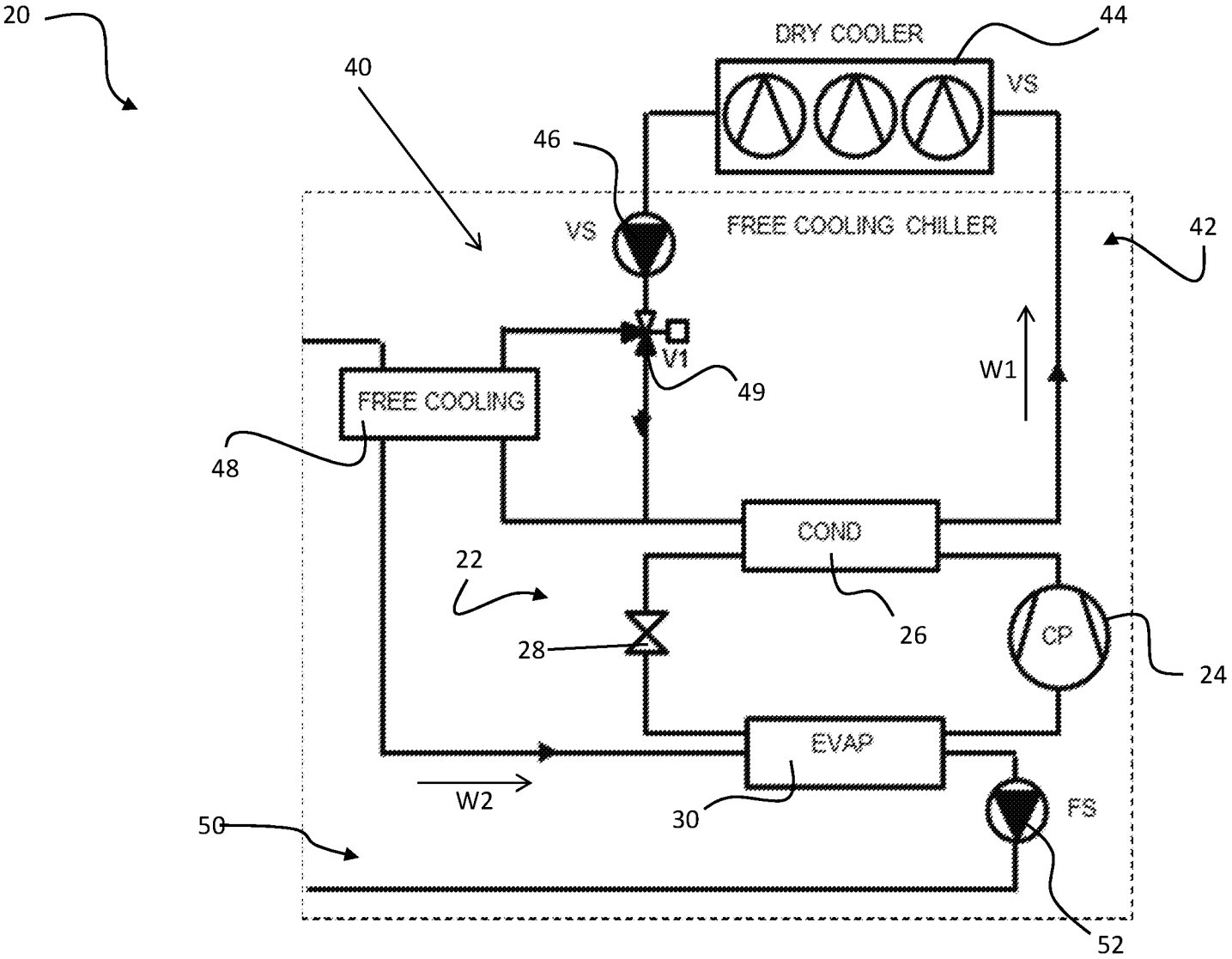
FIG. 1 is a schematic diagram of a refrigeration system according to an embodiment of the present disclosure.
Figure 2:
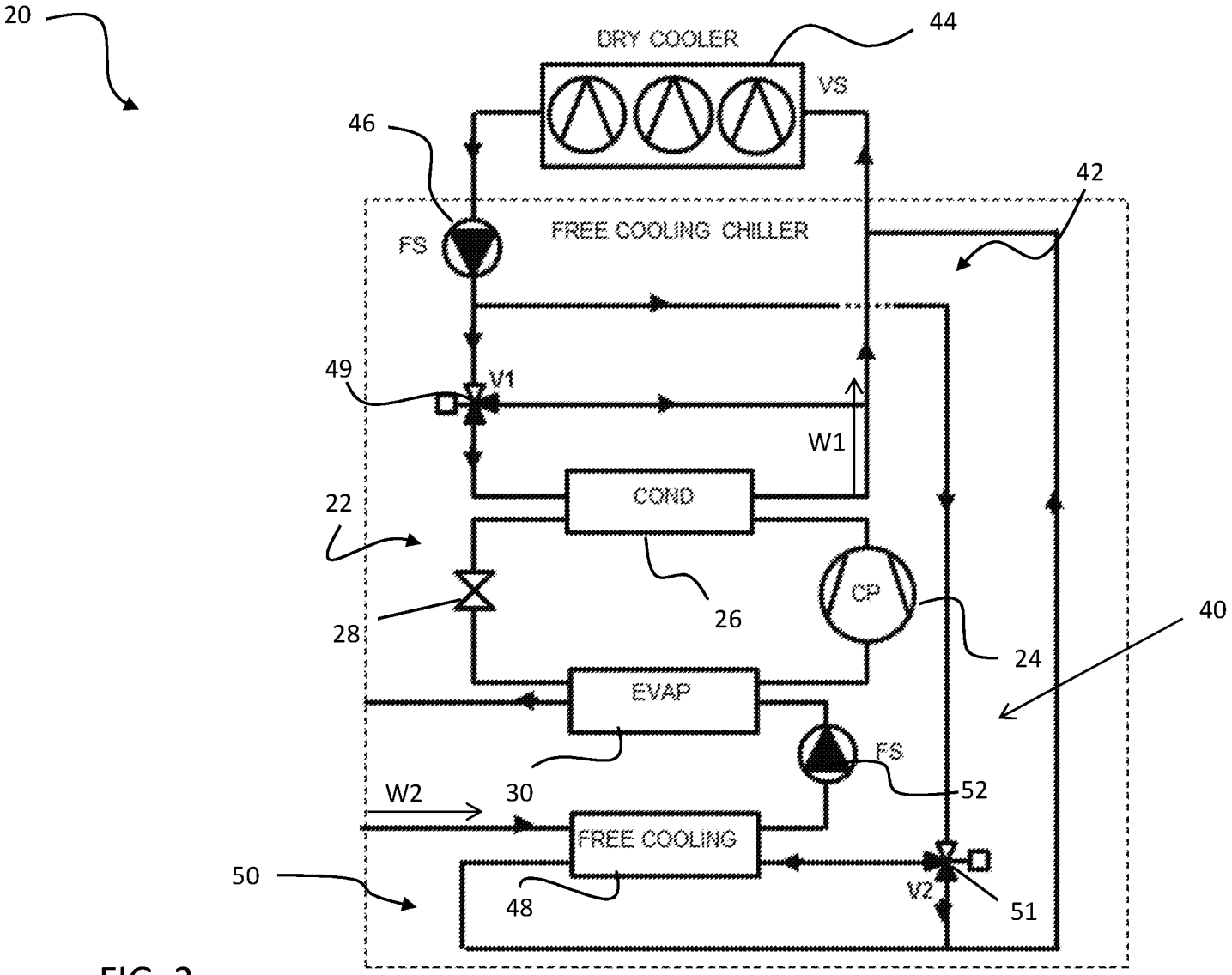
FIG. 2 is a schematic diagram of another refrigeration system according to another embodiment of the present disclosure.

Referring now to the FIGS. 1-2, various refrigeration systems, generally referred to by reference numeral 20, are illustrated. System 20 is configured to simultaneously perform both mechanical cooling and free cooling. The system 20 includes a refrigerant circuit 22 having a compressor 24, condenser 26, an expansion device 28, and an evaporator 30. The compressor 24 compresses a refrigerant and delivers it downstream into a condenser 26. From the condenser 24, the refrigerant passes through the expansion device 28 and then to the evaporator 30. From the evaporator 30, the refrigerant is returned to the compressor 24 to complete the closed-loop refrigerant circuit. A basic refrigeration circuit is illustrated and described herein. However, systems 20 having a more complex refrigeration circuit 22 are within the scope of the present disclosure. In addition, the refrigeration system 20 may include any number of refrigeration circuits 20 depending on the cooling requirements of a given application.

Each of the illustrated refrigeration systems 20 additionally includes a free cooling system 40 operably connected to the refrigeration circuit 22. The refrigeration circuit 22 and the free cooling system 40 may be packaged together and may be located at any location, for example indoors, in any technical room of a facility to be conditioned, on a roof or in a basement. In this configuration, the refrigeration system 20 is modular and easy to connect to a new or existing fluid network, such that the system 20 may be used in retrofit applications.

The free-cooling system 40 includes a first circuit or free cooling circuit 42, having a first fluid or free cooling fluid W1, such as ethylene/propylene glycol, brine or any other anti-freeze solution for example, flowing there through and a second circuit or cooling fluid circuit 50 having a second fluid W2, such as water, ethylene/propylene glycol, brine or any other solution for example, flowing there through. The free cooling first circuit 42 includes a dry or adiabatic cooler 44 configured to take advantage of the heat-removing capability of cool, ambient air, by arranging the air in a heat exchange relationship with the fluid W1 via a heat exchanger, such as a round tube heat exchanger for example, and one or more fixed speed or variable speed fans. As shown, the free-cooling circuit 42 and the refrigeration circuit 22 are thermally and hydraulically coupled together at the condenser 26 such that heat rejected from the refrigerant in the condenser is transferred to the free-cooling fluid W1 of the free cooling circuit 42. The condenser 26 is arranged generally downstream of the dry cooler 44.

The fluid W1 is driven through the first circuit 42 by a pump 46 such that the fluid W1 flows sequentially through the condenser 26 and the dry or adiabatic cooler 44. The pump 46 may be located at any positioned within the free-cooling circuit 42, such as adjacent an inlet or outlet of the dry or adiabatic cooler 44. The pump 46 may be configured as a fixed speed pump or as a variable speed pump operable to control a constant pressure differential or temperature differential or any other control modes. The second circuit 50 is configured to supply a fluid W2 to an environment to be conditioned and receive cooling fluid W2 from the environment to be conditioned. In one embodiment, the second circuit 50 may include a storage tank configured to store a portion of cooling fluid W2. The second circuit or cooling fluid circuit 50 and the refrigeration circuit 22 are hydraulically and thermally coupled together so as to allow the cooling fluid or second fluid W2 to be cooled in the evaporator 30. Similarly, the second circuit or cooling fluid circuit 50 and the first circuit, the free cooling circuit 42, are thermally and hydraulically coupled together at the free cooling heat exchanger 48. When arranged in a heat exchange relationship in the free cooling heat exchanger 48, the second fluid W2 is configured to reject heat to the first fluid W1.

A pump 52 is configured to drive the cooling fluid W2 through the second circuit 50. The pump 52 may be configured as a fixed speed pump or as a variable speed pump operable to control a constant pressure differential or temperature differential or any other control modes. In the illustrated non-limiting embodiment, the fluid W2 is provided first to the free-cooling heat exchanger 48 and then to the downstream evaporator 30. By positioning the free-cooling heat exchanger 48 upstream from the evaporator 30, the cooling fluid W2 is cooled prior to entering the evaporator 30. Based on the required cooling load of the refrigeration system 20, the cooling fluid W2 is cooled to a required temperature setpoint by activating the refrigeration system 20.

As previously stated, the refrigeration systems 20 disclosed herein are configured to perform combined mechanical cooling and free cooling. Referring now to FIG. 1, the free cooling heat exchanger 48 is positioned between the dry or adiabatic cooler 44 outlet and the condenser 26. More specifically, in the illustrated, non-limiting embodiment, the free cooling heat exchanger 48 and the condenser 26 are arranged in series such that all of the fluid W1 provided at an outlet of the free cooling heat exchanger 48 also passes through the condenser 26.

A valve 49 is configured to control the flow of fluid W1 through the free cooling heat exchanger 48. Although the valve is illustrated as a three-way valve, any type of valve is contemplated. For example, when the valve 49 is in a first position, all or at least a portion of fluid W1 is configured to flow through the free cooling heat exchanger 48 and the condenser 26 sequentially. However, when the valve 49 is in a second position, the fluid flow may be configured to bypass the free cooling heat exchanger 48 such that the fluid W1 only passes through the condenser 26. The valve 49 may be arranged at various locations in the first circuit 42, such as upstream from the free cooling heat exchanger 48. When the system 20 of FIG. 1, is operated in a mechanical-cooling mode, the flow of fluid W1 is configured to bypass the heat exchanger 48. In a free-cooling mode, however, at least a portion of the fluid W1 is configured to flow through the free cooling heat exchanger 48.

In another embodiment, illustrated in FIG. 2, the free cooling heat exchanger 48 is similarly provided downstream from the dry or adiabatic cooler 44 outlet. However, unlike the configuration of FIG. 1, the free cooling heat exchanger 48 is arranged in parallel with the condenser 26 such that fluid flow is distributed between free cooling heat exchanger 48 and condenser 26 within the first circuit 42. A first valve 49 arranged upstream from an inlet to the condenser 26 is configured to control a flow of the fluid W1 through the condenser. Similarly, a second valve 51 arranged upstream from an inlet of the free cooling heat exchanger 48 is configured to control a flow of the fluid W1 through the free cooling heat exchanger 48. The valves can be of two-way valve or three-way configuration. Together, valves 49 and 51 may be manipulated between a plurality of positions to operate the air refrigeration system in a free cooling mode, a mechanical cooling mode, and a combined free cooling and mechanical cooling mode. When the refrigeration system 20 of FIG. 2 is operated in a free-cooling mode, the fluid W1 is configured to bypass the condenser 26.

A controller 60 is configured to control operation of the refrigeration system 20. More specifically, the controller 60 is operably coupled to the compressor 24, pumps 46, 52, dry or adiabatic cooler fans 44, and the valves 49, 51 to control the cooling capacity of the system. In one embodiment, the controller 60 is configured to adjust operation of the refrigeration system 20 based not only the cooling demand on the system, but also on the temperature of the external ambient air.

The refrigeration system 20 described herein has a simplified and improved design compared to conventional systems, resulting in a reduced footprint. More specifically, these refrigeration systems 20 may be contained within a single package, rather than multiple packages. Because the refrigeration system 20 may be operated in a plurality of modes, the overall capability of the system is increased. For example, the system 20 may be operated in a free cooling only mode when the system has a low to moderate cooling requirement and may be operated in a combined free cooling and mechanical cooling mode for greater loads. This adaptability results in improved system efficiency which lowers the overall energy required for operation.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

I claim:

1. A refrigeration system comprising:

a refrigeration circuit including a compressor, a condenser, an expansion device, and an evaporator arranged in fluid communication such that a refrigerant is configured to cycle there through; and a free cooling system including:

a fluid cooling circuit thermally and hydraulically coupled to the refrigeration circuit such that a cooling fluid of the fluid cooling circuit is configured to transfer heat to the refrigerant;

a free cooling circuit thermally and fluidly coupled to the refrigeration circuit such that a free cooling fluid of the free cooling circuit is configured to absorb heat from the refrigerant, the free cooling circuit and the fluid cooling circuit being thermally and hydraulically coupled through a free cooling heat exchanger configured to transfer heat from the fluid cooling circuit to the free cooling circuit, wherein the free cooling heat exchanger is arranged directly upstream from the condenser with respect to a flow of the free cooling fluid through the free cooling circuit; and at least one valve configured to control the flow within the free cooling circuit, the at least one valve being movable between a plurality of positions, wherein when the at least one valve is in a first position of the plurality of positions, the system is operable in a free cooling mode where the free cooling heat fluid bypasses the condenser, when the at least one valve is in a second position of the plurality of positions, the system is operable in a mechanical cooling mode where the free cooling heat fluid is provided to the condenser, and when the at least one valve is in a third position of the plurality of positions, the system is operable in a combined free cooling and mechanical cooling mode where a first portion of the free cooling heat fluid is provided to the free cooling heat exchanger and a second portion of the free cooling heat fluid is provided to the condenser, and when the at least one valve is in a second configuration, the free cooling heat fluid bypasses the condenser, and when the at least one valve is in a third configuration, the free cooling fluid bypasses the free cooling heat exchanger.

2. The refrigeration system according to claim 1, wherein the free cooling circuit includes a heat exchanger configured to reject heat from the free cooling fluid to ambient air.

3. The refrigeration system according to claim 1, wherein the free cooling circuit is thermally and fluidly coupled to the condenser and the fluid cooling circuit is thermally and fluidly coupled to the evaporator.

4. The refrigeration system according to claim 1, wherein the at least one valve is positioned upstream from the free cooling heat exchanger.

5. The refrigeration system according to claim 4, wherein the at least one valve includes a valve positioned upstream from the condenser.

6. The refrigeration system according to claim 1, wherein the at least one valve is positioned downstream from the free cooling heat exchanger.

7. The refrigeration system according to claim 1, wherein the free cooling heat exchanger is located upstream of the evaporator with respect to a flow of the cooling fluid through the fluid cooling circuit.

8. The refrigeration system according to claim 1, wherein the free cooling circuit includes a pump configured to move the free cooling fluid through the free cooling circuit.

9. The refrigeration system according to claim 1, wherein the fluid cooling circuit includes a pump configured to move the cooling fluid through the fluid cooling circuit.

10. The refrigeration system according to claim 1, wherein the at least one valve includes a three-way valve.

11. The refrigeration system according to claim 1, further comprising a controller configured to control operation of the refrigeration system in one of the free cooling mode, the mechanical cooling mode, and the combined free cooling and mechanical cooling mode based on a cooling load and an outside temperature.

12. The refrigeration system according to claim 11, wherein the controller is operably coupled to the compressor, a pump, and the at least one valve, the controller being configured to operate one or more of the compressor, the pump, and at least one valve when switching between the plurality of positions associated with operation in the free cooling mode, the mechanical cooling mode and the combined free cooling and mechanical cooling mode.

* * * * *